US011104543B2

(12) United States Patent
Poulin et al.

(10) Patent No.: US 11,104,543 B2
(45) **Date of Patent: *Aug. 31, 2021**

(54) ELECTRIC CABLE REEL

(71) Applicant: NEXANS, Courbevoie (FR)

(72) Inventors: Nicolas Poulin, Auchy les Mines (FR); Olivier Pinto, Francheville (FR)

(73) Assignee: NEXANS, Courbevoie (FR)

( * ) Notice: Subject to any disclaimer, the term of this patent is extended or adjusted under 35 U.S.C. 154(b) by 127 days.

This patent is subject to a terminal disclaimer.

(21) Appl. No.: 16/347,301

(22) PCT Filed: Oct. 26, 2017

(86) PCT No.: PCT/FR2017/052951

§ 371 (c)(1),
(2) Date: May 3, 2019

(87) PCT Pub. No.: WO2018/087450

PCT Pub. Date: May 17, 2018

(65) Prior Publication Data

US 2019/0284016 A1 Sep. 19, 2019

(30) Foreign Application Priority Data

Nov. 9, 2016 (FR) ..... 16 60820

(51) Int. Cl.
*B65H 75/44* (2006.01)

(52) U.S. Cl.
CPC ..... *B65H 75/44* (2013.01); *B65H 75/4484* (2013.01); *B65H 2701/34* (2013.01)

(58) Field of Classification Search
CPC ..... B65H 75/4484; B65H 2701/34
See application file for complete search history.

(56) References Cited

U.S. PATENT DOCUMENTS

| | | | | |
|---|---|---|---|---|
| 4,236,449 | A * | 12/1980 | Price | B65H 26/00 101/228 |
| 5,395,065 | A * | 3/1995 | Hirose | A01K 89/015 242/223 |
| 5,967,445 | A * | 10/1999 | Yuyama | B65H 16/04 242/421.1 |
| 6,354,528 | B1 * | 3/2002 | Nagata | B60R 22/405 242/374 |
| 2005/0077413 | A1 * | 4/2005 | Nakagawa | E04G 21/123 242/422.4 |
| 2005/0087644 | A1 | 4/2005 | Kim | |
| 2009/0283167 | A1 * | 11/2009 | Nakagawa | E04G 21/123 140/111 |

(Continued)

FOREIGN PATENT DOCUMENTS

| | | |
|---|---|---|
| CA | 2305482 | 10/2001 |
| DE | 202013104456 | 10/2013 |

OTHER PUBLICATIONS

International Search Report dated Jan. 25, 2018.

*Primary Examiner* — William A. Rivera
(74) *Attorney, Agent, or Firm* — Sofer & Haroun, LLP

(57) ABSTRACT

The invention relates to an electrical cable reel. According to the invention, the reel comprises an arrangement (4) for remotely monitoring the absence of cable wound around the reel, said arrangement comprising a sensor (4A) and an electronic board connected to the sensor and linked to a remote application that is enabled.

6 Claims, 2 Drawing Sheets

(56) References Cited

U.S. PATENT DOCUMENTS

| | | | | |
|---|---|---|---|---|
| 2012/0056966 | A1* | 3/2012 | Maruyama | B65H 16/06 347/221 |
| 2015/0252538 | A1* | 9/2015 | Muratov | E01C 19/522 404/99 |
| 2016/0023863 | A1* | 1/2016 | Martin | G01D 5/3473 242/563.2 |
| 2019/0367320 | A1* | 12/2019 | Abbiati | B65H 75/182 |

* cited by examiner

ELECTRIC CABLE REEL

RELATED APPLICATION

This application is a National Phase of PCT/FR2017/052951, filed on Oct. 26, 2017, which claims the benefit of priority from French Patent Application No. 16 60820, filed on Nov. 9, 2016, the entirety of which are incorporated by reference.

BACKGROUND

Field of the Invention

The invention relates to a reel for an electric cable.

Description of Related Art

Currently, no reel for an electric cable allows automatic monitoring of the presence or absence of cable wound on the reel.

However, it may be very useful for the user or owner of the reel to check the presence of available electric cable in order, among other things, to place an order quickly when the stock thereof runs out.

OBJECTS AND SUMMARY

The invention solves this problem.

More specifically, the invention proposes a reel for an electric cable, characterized in that it has an arrangement for remote monitoring of the absence of cable wound on the reel, having a sensor and an electronic board connected to said sensor and linked to an active remote application.

According to one preferred embodiment, said monitoring arrangement is incorporated into a flange of the reel.

Preferably, said monitoring arrangement is incorporated into the inner face of said flange.

Advantageously, said sensor is an electromechanical end-of-travel sensor which is disposed at the edge of the drum and a rod of which is urged by a return force into a slot arranged in the inner face of said flange.

This type of mechanical sensor is particularly reliable and inexpensive.

Advantageously, the reel is also equipped with a geolocation arrangement.

The invention also relates to the use of such a reel, characterized in that said rod is disposed perpendicularly to said inner face of the reel, against the surface of the drum, when the electric cable is wound on the reel, this cable covering said rod.

Finally, the invention relates to a method for monitoring such a reel, characterized in that an alert is transmitted by said electronic board to said remote application when said rod is returned into said slot.

BRIEF DESCRIPTION OF THE DRAWINGS

The invention is described in more detail below with the aid of figures that show only a preferred embodiment of the invention.

DETAILED DESCRIPTION

As shown in the figures, a reel for an electric cable conventionally has a drum 1 about which a cable is intended to be wound, and two lateral flanges 2, 3.

According to the invention, it has an arrangement 4 for remote monitoring of the absence of cable wound on the reel, having a sensor 4A and a battery powered electronic board connected to the sensor and linked to an active remote application. This electronic board is contained in a housing 4B adjacent to the sensor 4A and comprises an arrangement for monitoring the state of the battery.

This monitoring arrangement 4 is incorporated in a flange 2 of the reel, and more specifically in the inner face 2A of this flange.

The sensor 4A is an electromechanical end-of-travel sensor which is disposed at the edge of the drum 1 and a rod 4A1 of which, having a rotary joint at one of its ends, is urged by a return force into a slot 2A1 arranged in the inner face 2A of the flange.

By way of example, this sensor may be an "RS Pro, NO/NF, 10A, 400V, IP65" electromechanical end-of-travel sensor sold by the company RS.

Figure 1:
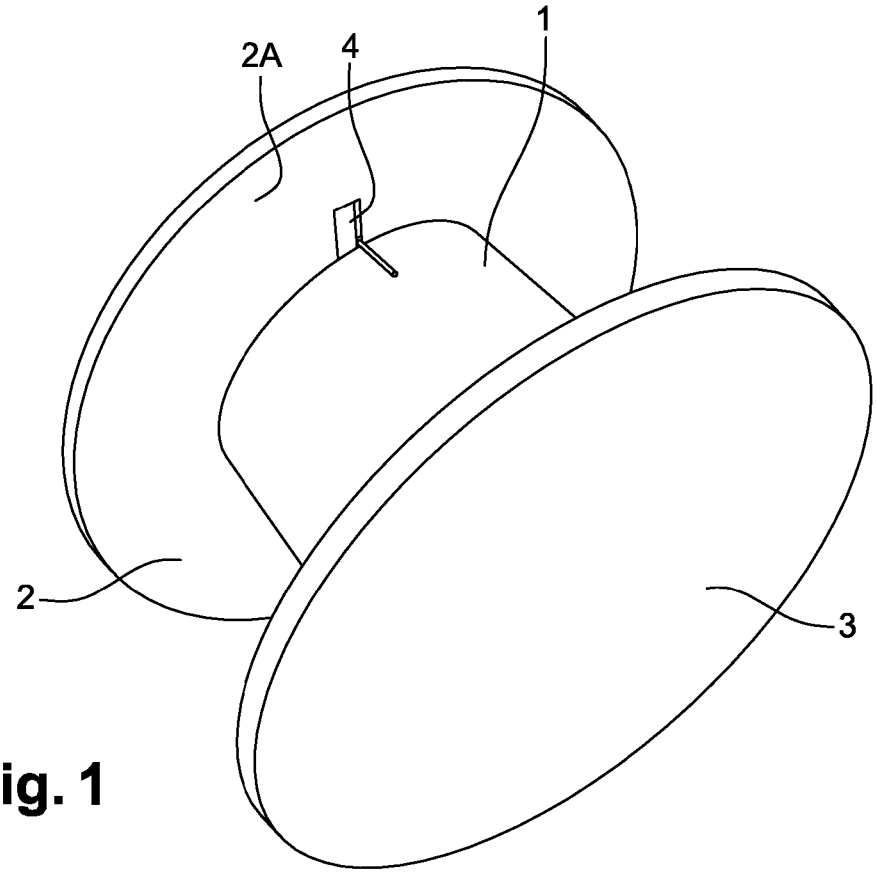
FIG. 1 is a perspective view of a reel according to the invention.
Figure 2:
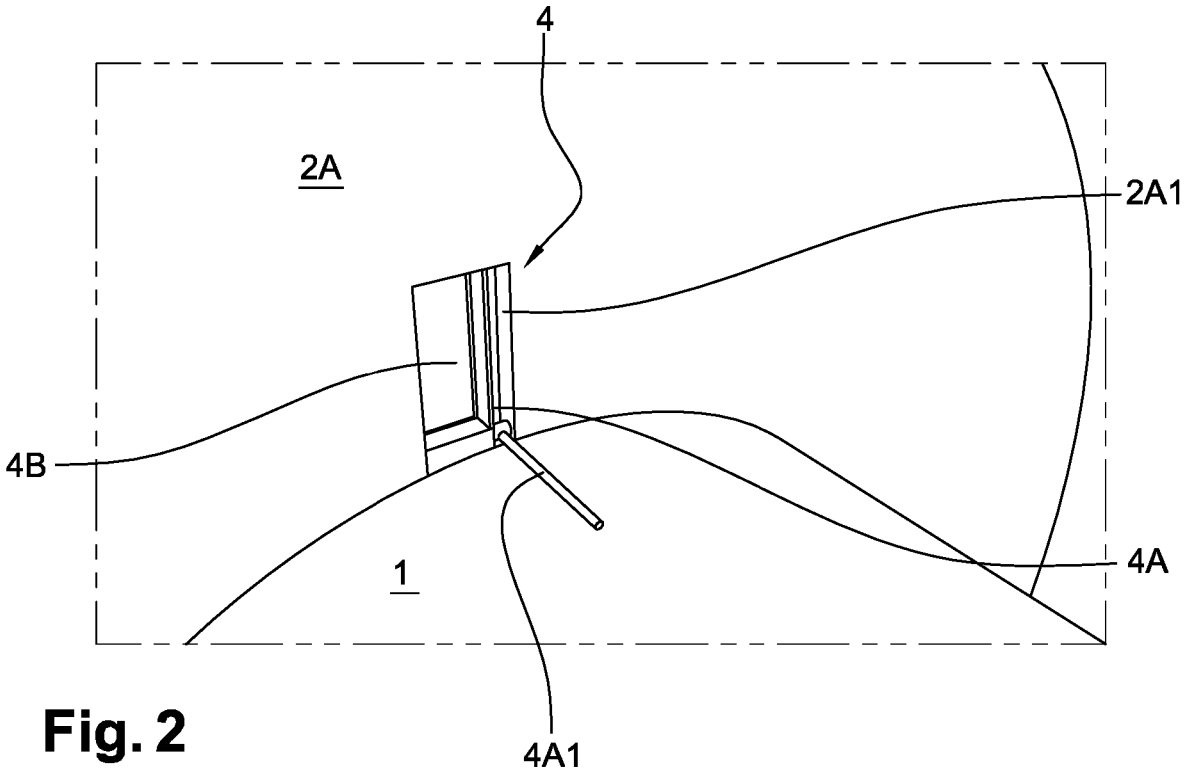
FIG. 2 is a detail view of a reel according to the invention before a cable has been wound thereon.

FIGS. 1 and 2 show the reel before a cable has been wound on the drum 1.

The rod 4A1 is then disposed perpendicularly to the inner face 2A of the reel, against the surface of the drum 1.

Figure 3:
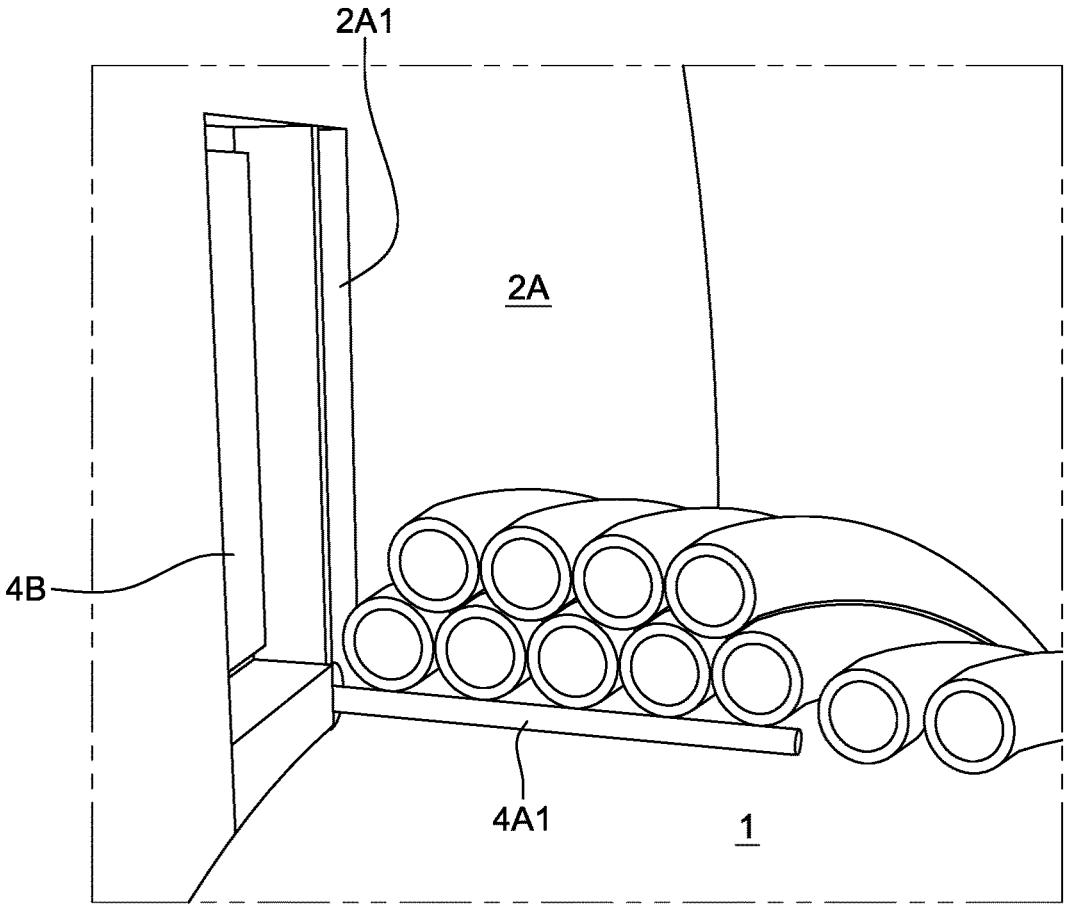
FIG. 3 is a sectional detail view of a reel according to the invention after a cable has been wound thereon.

When the electric cable is wound on the drum 1, as shown in FIG. 3, this cable covers the rod 4A1 and retains it in this position counter to the return force.

Figure 4:
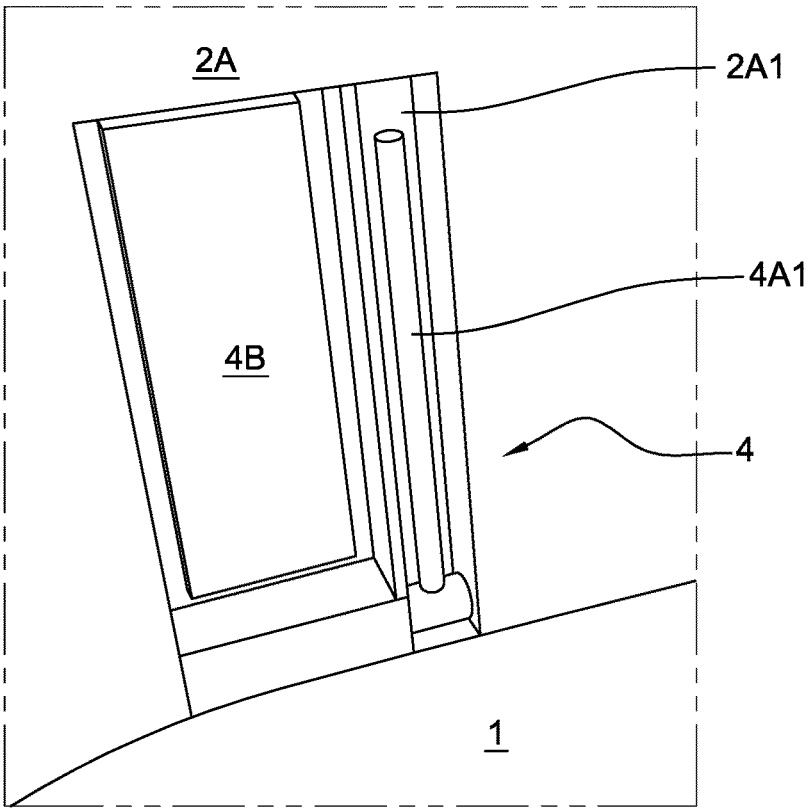
FIG. 4 is a perspective detail view of a reel according to the invention after the cable has been completely unwound.

When all of the cable has been unwound from the drum, as shown in FIG. 4, the rod 4A1 is released and, urged by the return force, is returned into the slot 2A1. In this position, an alert is transmitted by the electronic board to the remote application.

This remote application is preferably an application connected to a mobile network, in particular GSM (acronym for "Global System for Mobile Communications") or SIGFOX.

To allow the management of a set of such reels, each reel advantageously has an electronic identification number.

Each reel may have a geolocation arrangement in order to provide a user who needs a particular length of cable with the reference and the position of reels that can supply said user with the cable.

The invention claimed is:

1. An electric cable reel comprising:

an arrangement for remote monitoring of the absence of cable wound on the reel, having a sensor; and an electronic board connected to said sensor and linked to an active remote application, wherein said monitoring arrangement is incorporated into a flange of the reel.

2. The reel as claimed in claim 1, wherein said monitoring arrangement is incorporated into the inner face of said flange.

3. The reel as claimed in claim 2, wherein said sensor is an electromechanical end-of-travel sensor which is disposed at the edge of the drum and a rod of which is urged by a return force into a slot arranged in the inner face of said flange.

4. The reel as claimed in claim 3, wherein said rod is disposed perpendicularly to said inner face of the reel, against the surface of the drum, when the electric cable is wound on the reel, this cable covering said rod.

5. A method for monitoring a reel as claimed in claim 3, wherein an alert is transmitted by said electronic board to said remote application when said rod is returned into said slot.

6. The reel as claimed in claim 1, wherein said reel is also equipped with a geolocation arrangement.

* * * * *